US005705048A

United States Patent [19]

Oxley et al.

[11] Patent Number: 5,705,048

[45] Date of Patent: Jan. 6, 1998

[54] APPARATUS AND A PROCESS FOR REGENERATING A $CUCL_2$ ETCHANT

[75] Inventors: James E. Oxley, New Haven; Raymond J. Smialek, Cheshire, both of Conn.; Ronald A. Putt, Marietta, Ga.

[73] Assignee: Oxley Research, Inc., New Haven, Conn.

[21] Appl. No.: 624,825

[22] Filed: Mar. 27, 1996

[51] Int. Cl.[6] ..... C25B 1/26

[52] U.S. Cl. ..... 205/345; 205/582; 205/586; 204/269; 204/275

[58] Field of Search ..... 204/269, 275; 205/582, 586, 345

[56] References Cited

U.S. PATENT DOCUMENTS 5,035,778 7/1991 Bindra et al. ..... 204/94
5,421,966 6/1995 Oxley ..... 204/94

*Primary Examiner*—Arun S. Phasge
*Attorney, Agent, or Firm*—Bachman & LaPointe, P.C.

[57] ABSTRACT

The present invention relates to an apparatus and a process for regenerating a used etchant solution, which solution contains a metal in divalent form. The apparatus includes a tank which is originally supplied with the etchant solution; a first electrolytic cell for converting solution from the tank to a solution containing a high fraction of a monovalent form of the metal; and a second electrolytic tank for plating metal from the solution containing a high fraction of the monovalent form of the metal. The details of the process of the present invention are set forth in the disclosure.

12 Claims, 3 Drawing Sheets

APPARATUS AND A PROCESS FOR REGENERATING A $CUCL_2$ ETCHANT

BACKGROUND OF THE INVENTION present invention relates to a process and apparatus for electrolytically regenerating an acid cupric chloride etchant.

Acid cupric chloride etchant ($CuCl_2$/HCl) is used widely in printed circuit board fabrication, in particular to produce the innerlayers of the multilayer boards. This etchant currently accounts for more than 50% of printed circuit board fabrication and its use is growing.

The overall reaction during the etching of copper by cupric chloride/hydrochloric acid is:

$$Cu+CuCl_2=2CuCl \quad (1)$$

As this equation shows, the active etchant compound, $CuCl_2$, is consumed and total solution copper increases. At the present time, most printed circuit board fabricators regenerate their etchant solutions chemically, using oxidizers such as chlorine or hydrogen peroxide to restore $CuCl_2$. Apart from the hazards, inconvenience, and expense of chemical treatment, there are significant cost and environmental burdens associated with the regular disposal of the excess etchant which is produced. Where the safety hazards associated with chlorine are manageable, chlorine is the preferred oxidant for reasons of costs. Many board shops however, prefer to use the safer, more benign hydrogen peroxide/HCl system, despite its higher price.

The printed circuit board industry has recognized that significant cost and environmental incentives exist for developing an efficient electrolytic regeneration process to replace chemical regeneration. One such effort to meet the demands of the printed circuit board industry is described in U.S. Pat. No. 5,421,966 (hereinafter the '966 patent) to Oxley.

The '966 patent relates to an electrolytic apparatus and process for the on-line regeneration of acid cupric chloride etching baths. The apparatus utilizes a regeneration process which exactly reverses the reaction set out in equation (1) in order that the copper metal etched into the system is completely removed while at the same time maintaining the concentration of cuprous and cupric chloride within the desired range. A preferred system described in the '966 patent utilizes a flow-through graphite or carbon anode and a flow-by cathode, allowing for control of current/potential variables. The cell containing the anode and the cathode has the advantage of utilizing low operating voltage which results in less waste heat generation and lower electrical costs. Its simpler design allows also improved on-line process control, leading to improved operating efficiencies and reliability in terms of unscheduled maintenance and outages.

Despite the existence of the Oxley apparatus, there still remains a need for a more efficient and productive apparatus and process for regenerating a $CuCl_2$ etchant solution.

SUMMARY OF THE INVENTION

Accordingly, it is an object of the present invention to provide an improved apparatus and process for regenerating an etchant solution.

It is a further object of the present invention to provide an apparatus and process as above which has particular utility in regenerating an acid cupric chloride etchant.

It is yet a further object of the present invention to provide an apparatus and process as above which yields a high grade copper in marketable, slab form.

It is yet a further object of the present invention to provide an apparatus and process as above which performs efficiently over a wide range of current densities making it readily applicable to different printed circuit board throughput rates.

The foregoing objects are attained by the apparatus and the process of the present invention.

In accordance with one embodiment of the present invention, the apparatus for regenerating an etchant broadly operates on a sump containing a supply of used etchant solution to be regenerated, which etchant contains a metal, such as copper, chiefly in divalent form (cupric copper). The apparatus comprises a control tank for receiving etchant solution from the sump and for holding a solution which contains a high fraction of a monovalent form of said metal, e.g. cuprous copper. A first electrolytic means such as a first electrochemical cell operates on the solution from the control tank. The first electrolytic means converts the divalent form of the metal in that solution which is supplied from the sump to a solution containing a high fraction of the monovalent form of the metal. After being processed in the first electrolytic means, the solution containing a high fraction of the monovalent form of the metal is returned to the control tank. The apparatus includes a second electrolytic means, such as a second electrochemical cell, which is supplied with the solution containing a high fraction of the monovalent form of the metal. In the second electrochemical means, the monovalent form of the metal is converted into the metal, preferably in a slab form.

In a preferred embodiment of the present invention, the first electrolytic means comprises an electrolytic cell having an anode chamber with a flow through anode therein and a cathode chamber with a flow through cathode therein; while the second electrolytic means comprises an electrolytic plating cell having an anode chamber with a flow through anode therein and a cathode chamber with a flow-by cathode.

One of the principal advantages to the design of the apparatus of the present invention is that it lends itself to modularization. Cell anode and cathode chambers can be arranged in alternating order in a stack to provide sufficient area for a specific production requirement. This should facilitate customization of designs for different etching capacity demands. Still further, the apparatus of the present invention operates at 2 volts or less, compared to 6 to 9 volts for other etchant regeneration systems. The ability to operate at this lower voltage is particularly advantageous because it translates into lower electricity costs. Further, it eliminates the need to remove the heat generated by the excess power.

The process of the present invention broadly comprises providing a sump containing a supply of used etchant solution to be regenerated, which etchant contains a metal chiefly in divalent form; supplying the used etchant solution to a control tank; transferring a supply of the control tank solution containing the spent etchant to a first electrolytic cell and electrolytically converting much of the divalent form of the metal in that solution to a solution containing a high fraction of a monovalent form of said metal; returning the solution containing a high fraction of the monovalent form of the metal to the control tank; simultaneously supplying the solution to a second electrolytic cell and electrolytically converting the monovalent form of the metal in the solution to the metal itself in the second electrolytic cell. The process of the present invention further comprises supplying the used etchant solution to the first and second electrolytic cells as an anolyte.

Other details of the apparatus and the process of the present invention, as well as other objects and advantages are set forth in the following detailed description and the accompanying drawings wherein like reference numerals depict like elements.

DETAILED DESCRIPTION OF THE PREFERRED EMBODIMENT(S)

Figure 1:
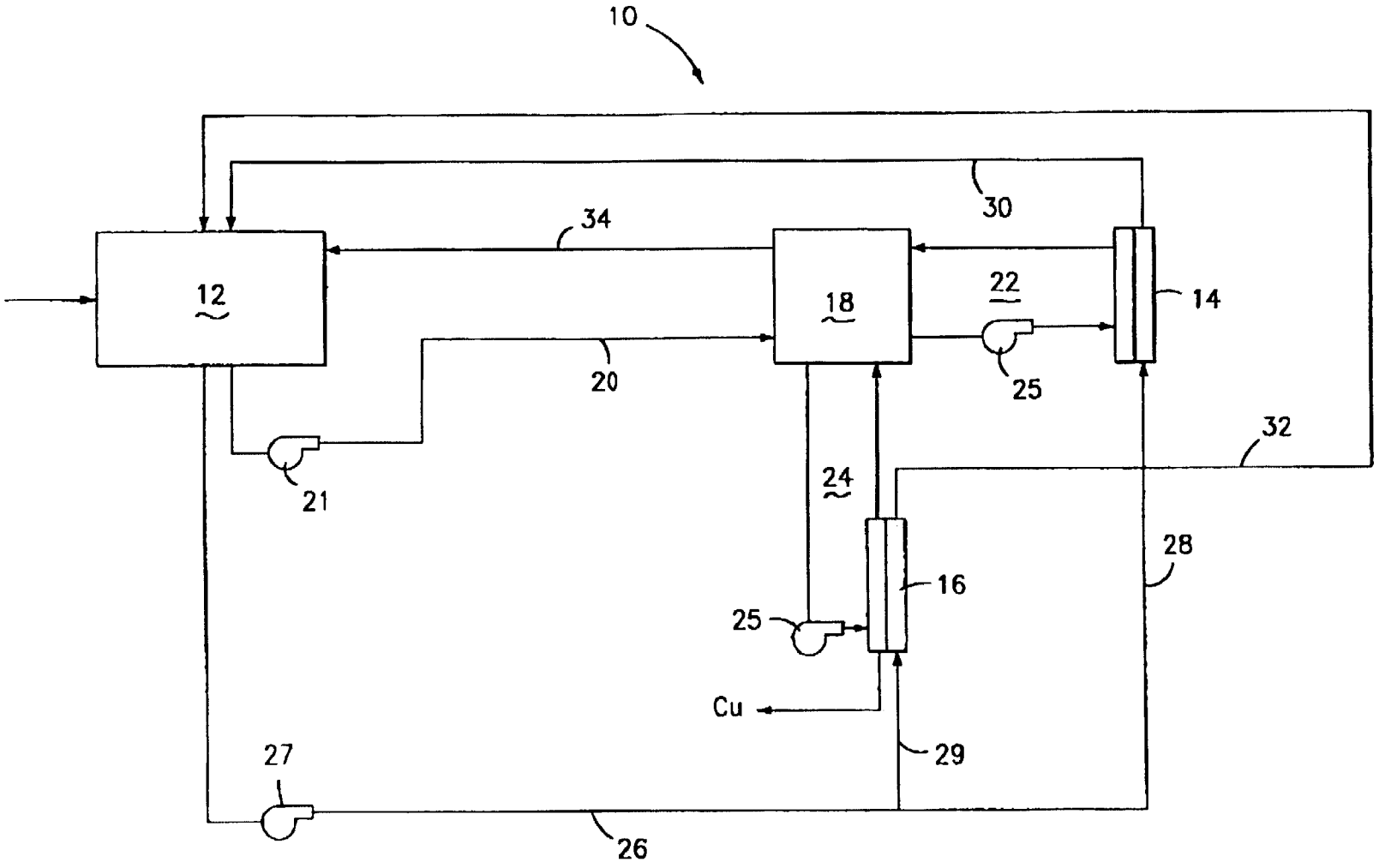
FIG. 1 is a schematic representation of the apparatus of the present invention.

Referring now to the drawings, FIG. 1 illustrates an on-line apparatus for maintaining the etching power of a $CuCl_2$ containing etchant by electrolytically regenerating $CuCl_2$ and simultaneously producing copper metal which can be recovered from the apparatus for re-sale. All of this is accomplished while the etchant $Cu^+$ ion concentration is held at the low levels required to achieve acceptable and consistent printed circuit board etching rates.

As will be described in more detail hereinafter, the reductions of $Cu^{2+}$ to $Cu^+$ and $Cu^+$ to copper metal are carried out in separate, prismatic electrolytic or electrochemical cells where the oxidation of $Cu^+$ to $Cu^{2+}$ is common to the anodic side of each cell. A prismatic design is made possible in the apparatus of the present invention by the use of highly efficient, porous flow-through electrodes which are preferably graphite or carbon for both the oxidation of cuprous to cupric and the reduction of cupric to cuprous. By using this type of electrode, it is possible to circumvent the occurrence of parasitic electrode reactions, in particular, anodic chlorine evolution, which has plagued other approaches. It has been found that plating copper from a solution of copper ions containing a high fraction of cuprous ions is the key to producing an even, essentially dendrite-free, copper electrodeposit. The copper is readily removable from the cathode substrate(s) in a single sheet and is of high purity. Additionally, the higher the ratio of cuprous to cupric ions in the solution, the greater is the electrical efficiency at which the copper is plated. Too low a fraction of cupric in the solution being plated from however, causes plating of copper at the flow-through cathode of the cell where $Cu^{2+}$ is reduced to $Cu^+$ which must be avoided.

Referring now to FIG. 1, the apparatus 10 of the present invention works on an etcher sump 12 which contains used $CuCl_2$ etchant. Typically, the etchant in the sump 12 contains a high concentration of $Cu^{2+}$, e.g., about 75 to 200 g/l $Cu^{2+}$. The apparatus includes a first electrolytic or electrochemical cell 14 known as a "knockdown" cell and a second electrolytic or electrochemical cell 16 which acts as a plating cell. In the knockdown cell, the cathode reaction is a reduction of cupric to cuprous. In the plating cell, cuprous is cathodically reduced to copper metal.

The apparatus 10 also includes a catholyte control tank 18. The solution in this tank contains a high fraction of cuprous with the cupric concentration in the solution preferably being held in the range of about 0.3 to about 2.5 g/l by the knockdown cell 14. If desired, the solution may contain from about 10 to about 25 ppm of a plating additive such as a surfactant so as to improve the quality of copper deposits by making them hold together better laterally and by increasing rigidity. Solution copper content remains substantially constant since the copper in the solution is replenished with etch solution make-up via line 20. A pump 21 can be incorporated into line 20 to generate a desired flow rate. An overflow line 34 is provided to return overflow solution from the tank 18 to the sump 12. Current in the knockdown cell 14 is set at a value somewhat higher than the current in the plating cell 16 to (a) reduce the cupric ion in solution fed from the sump 12 to the catholyte tank 18 as replacement for the copper deposited in the plating cell, and (b) to reduce the cupric ion in solution fed from the sump 12 to the catholyte tank 18 as make-up for the volume of catholyte overflowed from the catholyte tank to the sump, which allows space in the catholyte tank for incoming sump solution. The exact knockdown cell current is determined from the catholyte tank copper ion concentrations and the plating cell current.

As can be seen from FIG. 1, the solution in the tank 18 is supplied by flow loops 22 and 24 to the cathode sides of the cells 14 and 16. Each loop preferably has a pump 25 or other flow control means incorporated therein to generate a desired flow of catholyte solution. Typically, the catholyte flow rate will be in the range of from about 8.0 cm/sec to about 50.0 cm/sec for cell 16, and about 2.0 cm/sec to 10.0 cm/sec for cell 14.

The anode side of each cell 14 and 16 is fed from the etchant sump 12 via lines 28 and 29. The line 26 supplying lines 28 and 29 preferably has a pump 27 incorporated therein to create a desired flow of etchant/anolyte, preferably in the range of about 1.0 cm/sec to about 6.0 cm/sec, in lines 28 and 29. Return lines 30 and 32 are provided to return the etchant/anolyte to the sump 12. On the anode side, the reaction in each cell 14 and 16 is an oxidation reaction of cuprous to cupric.

Figure 2:
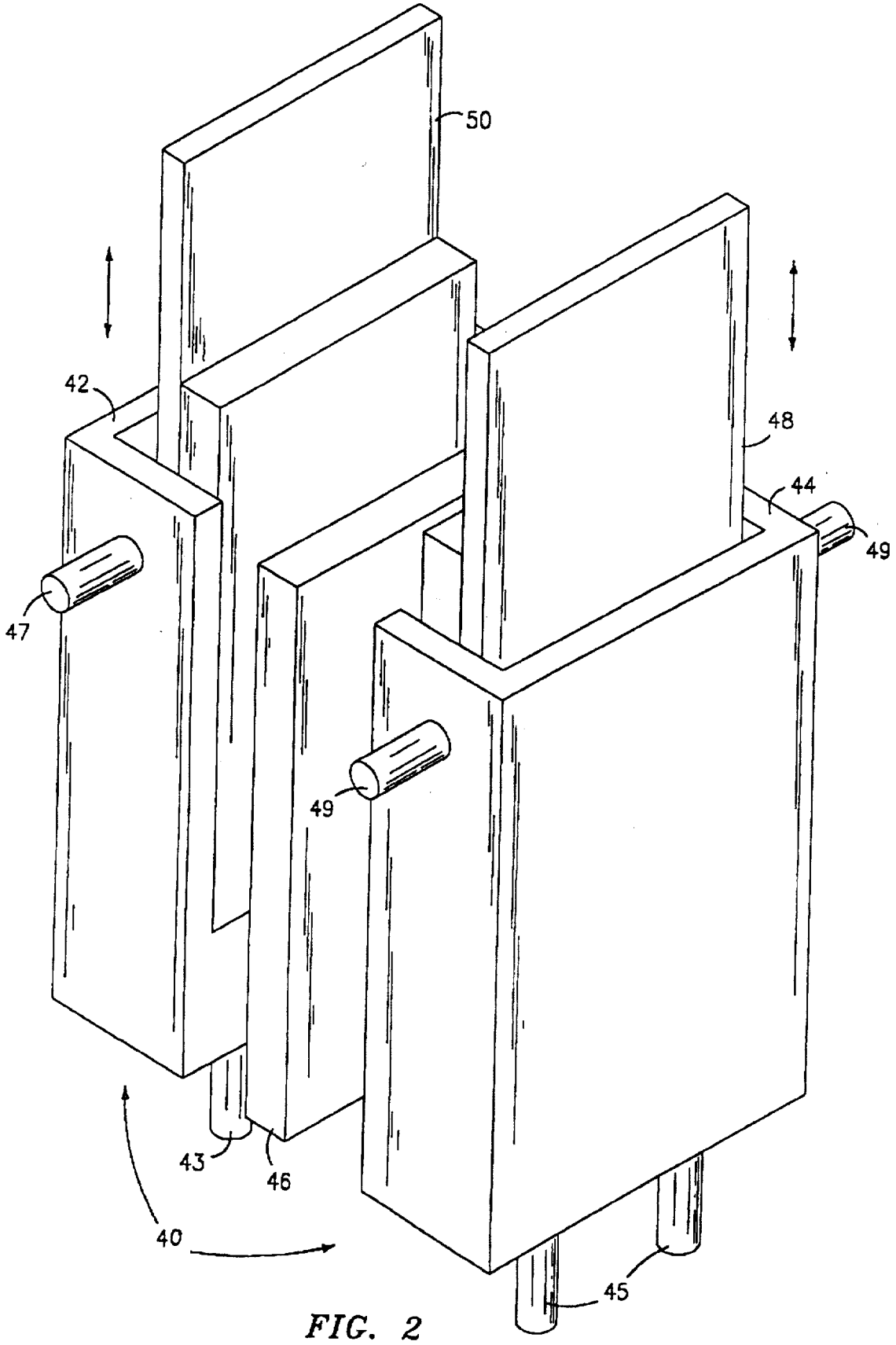
FIG. 2 is an isometric view of a first electrolytic cell for converting a solution containing a divalent form of a metal to a monovalent form.

Referring now to FIG. 2, the knockdown cell 14 is preferably formed by a tank 40 having a cathode chamber 42 and an anode chamber 44 separated by a separator wall 46. Preferably, the tank is fabricated from polyvinylchloride (PVC) although other plastics are permissible. The separator wall 46 preferably comprises a plate of solid PVC with a cut-out of the same dimensions as the anode and cathode fitted with a porous plate preferably formed from porous ceramic, sintered glass, or porous plastics which have been rendered hydrophilic over which is laid a similar sized sheet of hydrophilic membrane. Gaskets (not shown) are provided on both sides of the separator wall 46 to provide cell sealing. Each of the chambers 42 and 44 is provided with inlets 43, 45 and outlet 47, 49 for the respective catholyte and anolyte.

The anode chamber 44 includes an anode 48 and the cathode chamber includes a cathode 50. Both of these high surface area electrodes are formed from a flow-through porous electrode, preferably graphite or carbon felt. This type of electrode is used for both the anode and the cathode because of the low concentration of the ion whose reaction is being promoted at each electrode.

Figure 3:
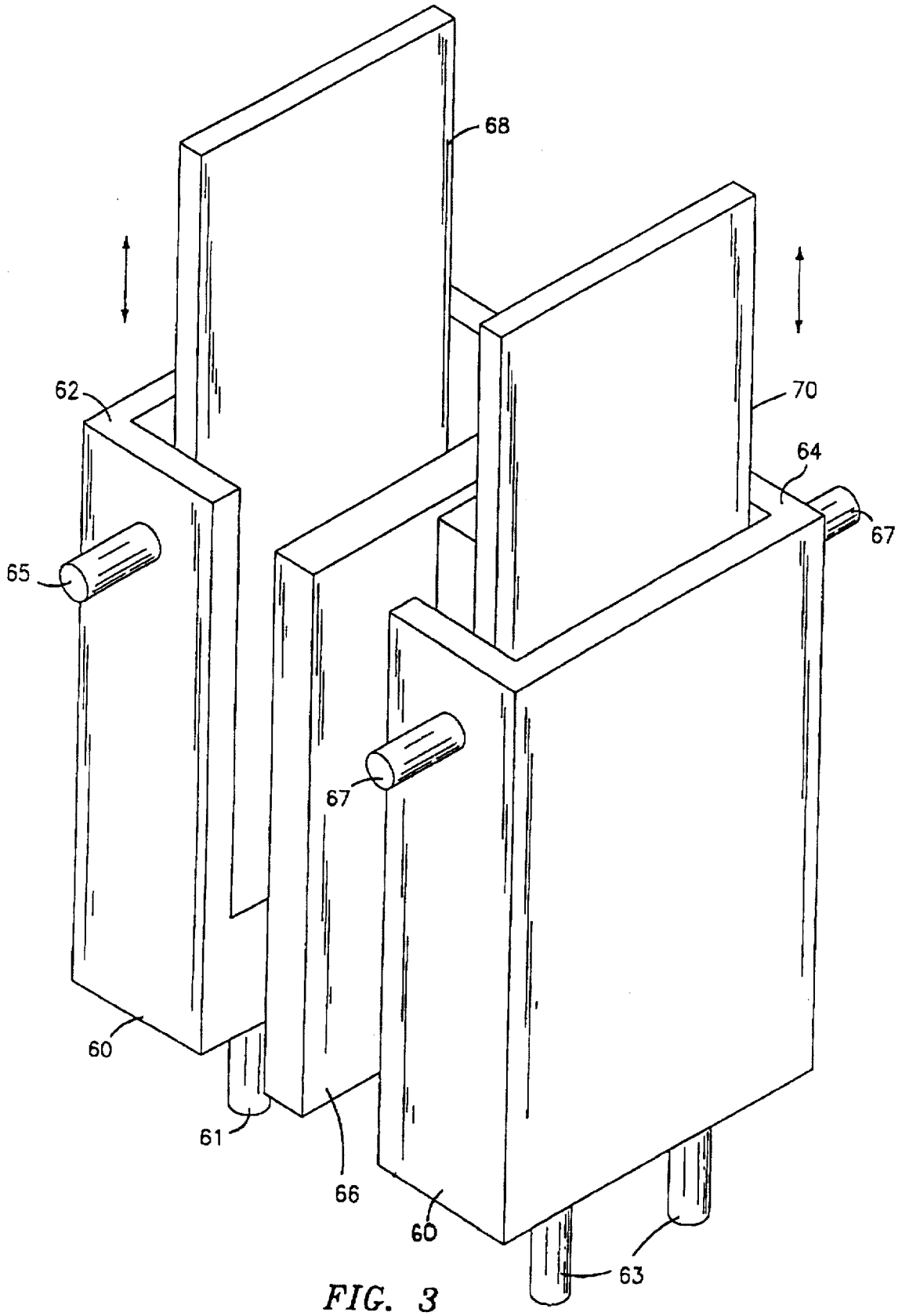
FIG. 3 is an isometric view of a second electrolytic cell for plating metal from a catholyte solution primarily containing said metal in monovalent form.

Referring now to FIG. 3, the plating cell 16 also comprises a tank 60 having a cathode chamber 62 and an anode chamber 64 separated by a separator wall 66. The tank 60 is also fabricated from a chemically resistant plastic, preferably PVC. The separator wall 66 is also preferably formed by a plate of solid PVC with a porous window (as above). Gaskets (not shown) are also provided on both sides of the separator wall 66 to provide cell sealing. Each of the chambers 62 and 64 is provided with inlets 61, 63 and outlets 65, 67 so that the respective catholyte/anolyte can flow therethrough.

The cathode chamber 62 preferably has one or more cathodes 68, each of which is a flow-by graphite plate cathode. The cathode(s) 68 are arranged so that the cathode (s) can be periodically removed to harvest the copper metal plated thereon. The anode chamber 64 has an anode 70 which preferably comprises a flow-through porous electrode preferably graphite or carbon felt.

The anode and cathode(s) in each of the cells 14 and 16 are connected to a suitable power source (not shown) for providing a desired current level. Any suitable electrical connections known in the art may be used to connect the anodes and cathodes to the power source. For a system sized for 100 g/hr, a current of about 65.8 Amps may be provided across the anode and cathode in the knockdown cell 14 and a current of 46.9 Amps may be provided across the anode and cathode in the plating cell 16 to cause the desired oxidation and reduction reactions.

It has been found that using the apparatus 10 of the present invention that copper plating rates above 0.18 grams/hour per $cm^2$ can be achieved. Further, deposits of acceptable quality can occur at current densities up to about 120 $mA/cm^2$.

One of the advantages in plating copper from a solution with a high level of cuprous ions is that intermittent operation is permissible. The copper already plated remains undissolved when the plating current is turned off and the cathode is still submerged in catholyte. This is a significant advantage for smaller printed circuit board shops who would then have the option of discontinuous operation while still maintaining constant operating conditions.

In operation, a used $CuCl_2$ etchant containing a concentration of $Cu^{2+}$ ions is located in a sump 12, which may be a sump in an etcher. The used etchant is supplied to a catholyte control tank 18, which tank overflows an equal volume of lower copper content solution back to the etchant sump. Solution from the catholyte control tank is supplied to the cathode side of a knockdown cell 14. Etchant from the sump 12 is fed to the anode side of the cell 14. A current is applied across the cell 14. On the cathode side, $Cu^{2+}$ ions in the catholyte solution are converted to a concentration of $Cu^{+}$ ions. The reduced catholyte solution is returned to the tank 18. On the anode side of cell 14, a portion of the low concentration of $Cu^{+}$ in the anolyte is oxidized to $Cu^{2+}$. Simultaneously, catholyte solution which contains a high fraction of cuprous ions is fed from the tank 18 to the cathode side of a plating cell 16 and etchant from the sump 12 is fed to the anode side of the plating cell 16. A current is applied across cell 16. On the cathode side, copper metal is plated out of the catholyte solution onto the cathode. On the anolyte side of the cell 16, $Cu^{+}$ is oxidized to $Cu^{2+}$.

If desired, a $N_2$ padding can be placed over the catholyte solutions to substantially prevent or minimize the chemical oxidation of $Cu^{+}$ to $Cu^{2+}$.

While the present invention has been described in the context of regenerating $CuCl_2$ etchant solutions, it should be recognized that the apparatus and process of the present invention may be used to regenerate other types of solutions.

It is apparent that there has been provided in accordance with the present invention an apparatus and process for regenerating a $CuCl_2$ etchant which fully satisfies the objects, means and advantages set forth hereinbefore. It should be apparent to those skilled in the art that other modifications, variations and alternatives can be made to the present invention. It is intended that these modifications, variations and alternatives be embraced by the present disclosure.

What is claimed is:

1. An apparatus for regenerating a used etchant solution in a sump, said used etchant solution containing a metal in divalent form, said apparatus comprising:

means for supplying said used etchant solution to a control tank;

first electrolytic means connected to said control tank for receiving solution containing said metal in said divalent form from said control tank and for converting said solution with said divalent form of said metal into a solution containing a high fraction of a monovalent form of said metal;

means for returning said solution containing a high fraction of said monovalent form of said metal to said control tank;

means for returning overflow of solution from said control tank to said sump; and second electrolytic means communicating with said control tank for receiving said solution containing a high fraction of said monovalent form of said metal and for converting said monovalent form of said metal to said metal.

2. The apparatus of claim 1 further comprising means for feeding said used etchant solution to said first and second electrolytic means as an anolyte.

3. The apparatus of claim 1 wherein said metal in said divalent form comprises cupric copper and said first electrolytic means converts cupric copper to cuprous copper and said second electrolytic means converts cuprous copper to copper metal.

4. The apparatus of claim 1 wherein:

said first electrolytic means comprises an electrochemical cell having an anode chamber and a cathode chamber;

said anode chamber has a flow through anode therein; and said cathode chamber has a flow through cathode therein.

5. The apparatus of claim 4 wherein said flow through anode and said flow through cathode are each formed by a flow-through electrode formed from graphite or carbon felt.

6. The apparatus of claim 5 wherein said etchant solution is supplied to said anode chamber and said solution containing a high fraction of the monovalent form of said metal is supplied to said cathode chamber.

7. The apparatus of claim 1 wherein:

said second electrolytic means comprises a plating cell having a cathode chamber and an anode chamber;

said cathode chamber having a flow-by cathode; and said anode chamber having a flow through anode.

8. The apparatus of claim 7 wherein said flow-by cathode comprises a flow-through graphite or carbon felt anode and said cathode comprises a flow-by graphite plate cathode.

9. A process for regenerating a solution of used etchant in a sump, said used etchant solution containing a concentration of a metal in divalent form, said process comprising the steps of:

supplying a quantity of said etchant solution containing said metal in divalent form to a control tank;

forcing an overflow of solution from said control tank to said sump;

supplying solution from said control tank to a first electrolytic cell;

electrolytically converting said solution with said divalent form of said metal in said first electrolytic cell to a solution containing a high fraction of a monovalent form of said metal;

returning said solution containing a high fraction of said monovalent form of said metal to said control tank;

supplying said solution containing a high fraction of said monovalent form of said metal from said control tank to a second electrolytic cell; and electrolytically converting said monovalent form of said metal in said solution to said metal in said second electrolytic cell.

10. The process of claim 9 further comprising feeding said used etchant solution as an anolyte to said first and second electrolytic cells.

11. The process of claim 9 wherein:

said metal in said divalent form in said etchant comprises cupric copper;

said first electrolytic converting step comprises converting said cupric copper to cuprous copper in said first electrolytic cell; and said second electrolytic converting step comprises converting said cuprous copper to copper in said second electrolytic cell.

12. The process of claim 11 further comprising maintaining a solution in said tank having a concentration of said cupric copper in the range of from about 0.3 g/l to about 2.5 g/l.

* * * * *